US007800289B2

(12) United States Patent
Weger

(10) Patent No.: US 7,800,289 B2
(45) Date of Patent: Sep. 21, 2010

(54) ELECTRODELESS GAS DISCHARGE LAMP

(75) Inventor: Robert Weger, Bauordenstrasse (AT)

(73) Assignee: Minebea Co., Ltd., Nagano-Ken (JP)

( * ) Notice: Subject to any disclaimer, the term of this patent is extended or adjusted under 35 U.S.C. 154(b) by 715 days.

(21) Appl. No.: 11/581,474

(22) Filed: Oct. 17, 2006

(65) Prior Publication Data

US 2007/0138927 A1 Jun. 21, 2007

(30) Foreign Application Priority Data

Oct. 20, 2005 (DE) ..... 10 2005 050 306

(51) Int. Cl.

| | |
|---|---|
| ***H01J 1/50*** | (2006.01) |
| ***H01J 3/20*** | (2006.01) |
| ***H01J 3/32*** | (2006.01) |
| ***H01J 23/10*** | (2006.01) |
| ***H01J 29/76*** | (2006.01) |

(52) U.S. Cl. ..... 313/161; 313/153; 313/160

(58) Field of Classification Search ..... 336/212–216; 313/153–162

See application file for complete search history.

(56) References Cited

U.S. PATENT DOCUMENTS

| | | | | |
|---|---|---|---|---|
| 4,117,378 A | | 9/1978 | Glascock | |
| 4,298,828 A | * | 11/1981 | Justice et al. | 315/248 |
| 4,422,017 A | | 12/1983 | Dennemen et al. | |
| 4,528,481 A | * | 7/1985 | Becker et al. | 315/248 |
| 5,335,163 A | * | 8/1994 | Seiersen | 363/126 |
| 5,834,905 A | * | 11/1998 | Godyak et al. | 315/248 |
| 6,084,359 A | | 7/2000 | Hetzel et al. | |
| 6,555,954 B1 | * | 4/2003 | Chandler et al. | 313/485 |
| 2002/0036472 A1 | * | 3/2002 | Kurachi et al. | 315/246 |

FOREIGN PATENT DOCUMENTS

| | | |
|---|---|---|
| EP | 0119666 | 6/1987 |
| EP | 0586180 A1 | 3/1994 |
| EP | 1235255 A1 | 8/2002 |
| EP | 1303170 A1 | 4/2003 |
| EP | 1340243 | 9/2003 |
| EP | 0767485 B1 | 4/2004 |
| GB | 1555094 | 11/1979 |

* cited by examiner

*Primary Examiner*—Toan Ton
*Assistant Examiner*—Zachary Snyder
(74) *Attorney, Agent, or Firm*—Duane Morris LLP

(57) ABSTRACT

The invention relates to an electrodeless high frequency gas discharge lamp according to the induction principle that, as a result of its design and construction, shows particularly low electromagnetic interference with a simultaneous increase in light efficiency. The gas discharge lamp according to the invention owes these advantageous properties on the one hand to the high coupling factor between the discharge current and the exciting current and, on the other hand, to the essentially homogeneous field conditions in the discharge vessel, which has been achieved by designing the discharge vessel to take the form of a hollow cylindrical ring which is seated directly over the exciter winding that extends over the entire length of the discharge vessel on a fully-closed, highly-permeable ferrite core.

14 Claims, 2 Drawing Sheets

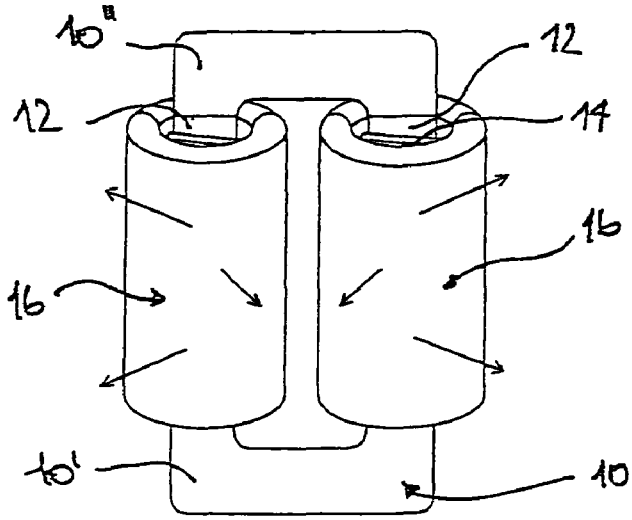
Fig. 1
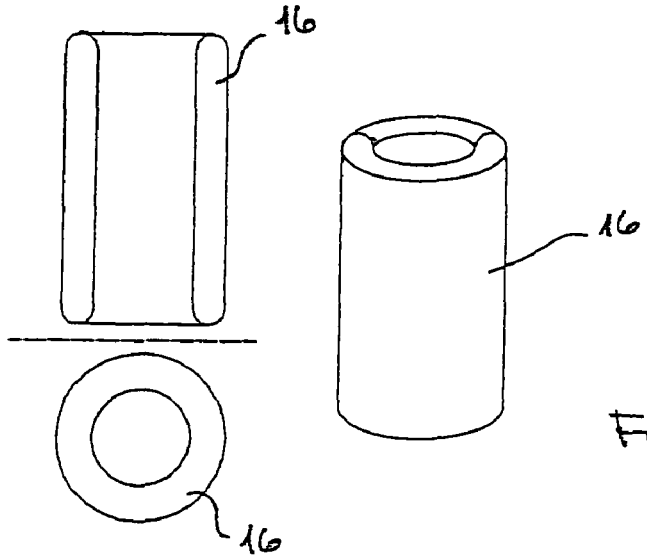
Fig. 2b
Fig. 2c
Fig. 2a
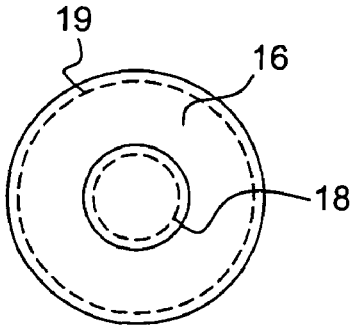
Fig. 3

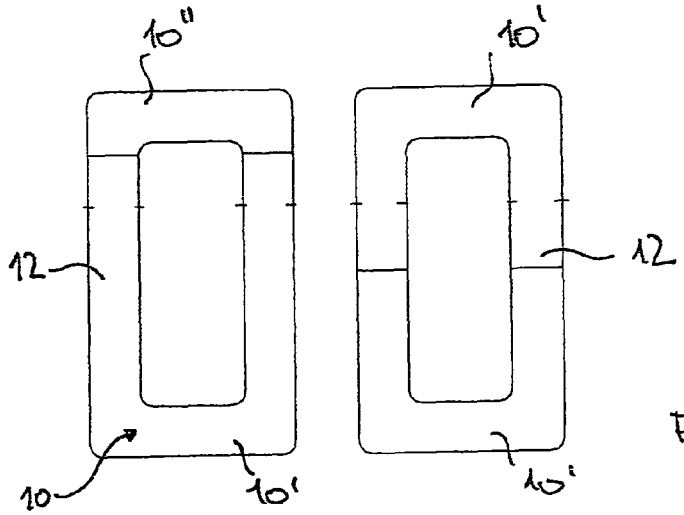
Fig. 4a
Fig. 4b
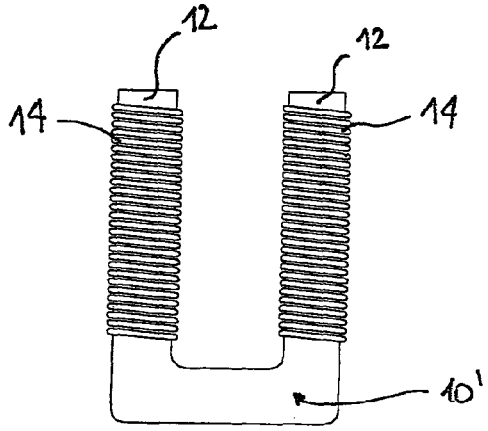
Fig. 5
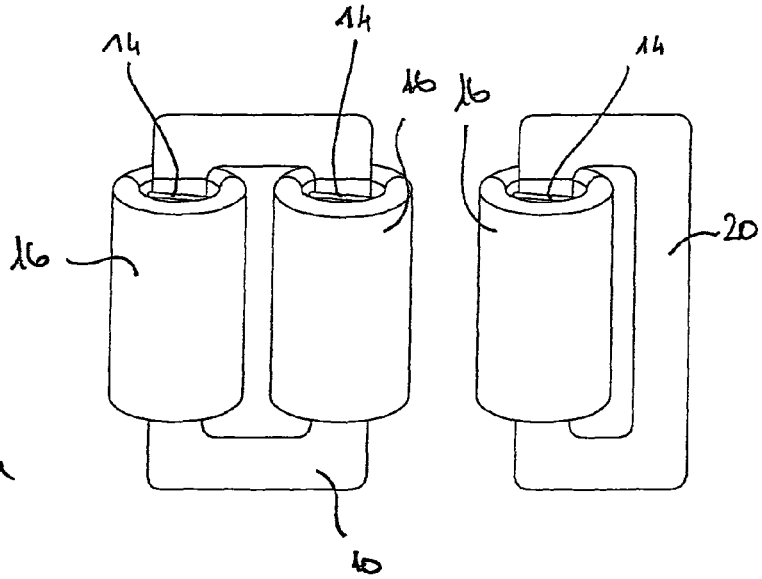
Fig. 6a
Fig. 6b

ELECTRODELESS GAS DISCHARGE LAMP

FIELD OF THE INVENTION

The invention relates to an electrodeless gas discharge lamp having a discharge vessel that is filled with a gaseous medium under highly reduced pressure ($<10^{-3}$. . . $10^{-6}$ bar) and having an induction coil that comprises a closed core made of magnetic material onto which an exciter winding is mounted, the exciter winding being fed by a high frequency oscillator. The closed core partly extends through a tubular channel within the discharge vessel. This kind of lamp is known from DE 30 08 535 C2.

BACKGROUND OF THE INVENTION

In electrodeless gas discharge lamps that operate according to the induction principle, an electric discharge or a plasma is generated and maintained in a discharge vessel or lamp envelope by means of a high frequency alternating electromagnetic field. The transformation of electric energy into light is achieved by the excitation of atoms in the plasma discharge by means of impact ionization in the electric field. In contrast to the widely used fluorescent lamps which mainly use hot electrodes (HCFL) or, less commonly, cold electrodes (CCFL), electrodeless gas discharge lamps do not need any electrodes at all. The electric excitation field that the discharge triggers and feeds is generated by an oscillating high frequency magnetic field. It is well known that the absence of electrodes in the discharge vessel makes it possible to prolong the useful service life of the gas discharge lamps by five to ten times. Familiar ageing mechanisms for gas discharge lamps due to evaporation or electric erosion (sputter processes) of the electrode coating do not occur in electrodeless lamps. And by the very nature of the electrodeless lamps, there are no electrode losses, so that the efficiency of electrodeless gas discharge lamps is greater than that of HCFL and CCFL. Since there are no electrodes within the discharge vessels and thus no electrode chemistry that need be taken into account, the choice of possible active media for the purpose of generating the discharge plasma within the discharge vessel is made very much wider. Whereas nowadays mixtures of metal vapor, particularly mercury vapor, and rare gas are commonly used as active media, in the case of electrodeless lamps non-toxic, mercury-free active media may also come into consideration.

In the prior art, two different types of electrodeless gas discharge lamps which operate on the principle of magnetic induction are basically known. Commercially available at the present time are the electrodeless gas discharge lamps made by Philips and Matsushita, which use rod-shaped cores that extend into the lamp envelope, and also the lamps from Osram and Hongyuan, which use annular discharge tubes onto which the toroidal ferrite cores are mounted. For the sake of completeness, it should be mentioned that electrodeless gas discharge lamps are also known that operate without magnetic cores, a coil being wound directly about the glass envelope.

DE 30 08 535 C2 by Philips describes an electrodeless gas discharge lamp having a lamp base and a lamp vessel filled with a metal vapor and rare gas in which a multi-part annular core made of magnetic material, fed by a high frequency oscillator disposed in the lamp base, is so disposed that it partly extends through a tubular channel within the lamp vessel. The magnetic core consists of two separable parts, of which one part lies within the tubular channel of the lamp vessel and the other part is located outside the lamp vessel in the base. The magnetic core outside the lamp vessel carries an induction coil that is fed by the high frequency oscillator. Further windings of a copper foil strip are wound about the part of the toroidal core that lies in the tubular channel within the lamp vessel to facilitate ignition of the lamp.

DE 100 58 852 A1 describes an electrodeless low pressure gas discharge lamp having a ball-shaped, ring-shaped, pear-shaped or ellipsoidal glass body which is used as a gas discharge receptacle. The electric energy is introduced into the discharge receptacle in an inductive manner using a ring-shaped closed ferrite core which is partially located within the discharge receptacle and is provided with a primary winding that is fed in a frequency range of 100 kHz to 500 kHz. Part of the ring-shaped ferrite core is introduced into the discharge receptacle by means of a vacuum-tight passage that is inserted into the glass body. The part of the ferrite core having the primary winding is disposed in a lamp base outside the glass envelope.

DE 28 09 957 describes a fluorescent lamp having a substantially globular envelope that contains a gaseous medium and has a channel. An annular magnetic core partly extends through this channel and carries a winding to induce an electric field in the gaseous medium.

Available on the market under the name Osram Endura® is an electrodeless gas discharge lamp made by Osram GmbH which comprises an annular tubular discharge envelope on opposite sides of which two toroidal cores that carry exciter windings are mounted. The gas discharge lamp operates like a transformer, the exciter windings forming the primary windings of the transformer and the gas discharge tube forming the secondary winding of the transformer into which electric power is inductively coupled.

All electrodeless gas discharge lamps of the prior art have the disadvantage that they generate an extensive amount of electromagnetic interference.

It is thus an object of the invention to provide an electrodeless gas discharge lamp whose properties with regard to electromagnetic interference (EMI/EMC) are an improvement on those of gas discharge lamps of the prior art.

SUMMARY OF THE INVENTION

According to the invention, the electrodeless gas discharge lamp is constructed in the same way as a conventional transformer. It uses a closed core made of a soft magnetic material, such as ferrite, the core being, for example, a UU-core or a UI-core. The closed core can also be described as ring-shaped, although its shape need not be rotationally symmetric but rather resemble a closed rectangular or polygonal ring. The core comprises at least one substantially straight leg, particularly two parallel straight legs, with either one or both legs carrying an exciter winding that forms the primary coil of the transformer and induces the gas discharge in the discharge vessel. The discharge vessel takes the form of a hollow cylindrical ring that encloses the wound leg at a short spacing. As a result of the oscillating magnetic flux in the core, closed field lines are produced in the discharge vessel along which free charge carriers are accelerated and excite atoms of the active medium through collision processes. The oscillating magnetic flux is generated by means of the high frequency alternating voltage at the primary winding or through the resulting current flow respectively. The choice of active medium is determined by the requirement placed on light efficiency and spectral distribution. The amount of gas pressure is determined on the basis of optimum light efficiency or on the basis of ignition criteria. Ignitability requires low gas pressure in the millibar range or lower. Due to the spatially confined arrangement between the plasma current generated in the discharge vessel and the inducing current in the exciter winding, external magnetic fields are largely annihilated, or expressed otherwise: due to the excellent coupling between the primary and secondary coil (plasma), interference radiation is extensively precluded. The geometry of the core, exciter winding and discharge vessel proposed in the present invention makes it possible to achieve uniform field intensities and current densities in the entire discharge region. This results in optimum conditions for light emission and for efficiency over the entire length of the lamp.

The invention thus reveals an electrodeless high frequency gas discharge lamp according to the induction principle that, as a result of its design and construction, shows particularly low electromagnetic interference with a simultaneous increase in light efficiency. The gas discharge lamp according to the invention owes these advantageous properties on the one hand to the high coupling factor between the discharge current and the exciting current and, on the other hand, to the essentially homogeneous field conditions in the discharge vessel, which has been achieved by designing the discharge vessel to take the form of a hollow cylindrical ring which is seated directly over the exciter winding that extends over the entire length of the discharge vessel on a fully-closed, highly-permeable ferrite core.

The gas discharge lamp according to the invention has the added advantages that the discharge vessel and the transformer core are fully separable from each other and that the manufacture of the discharge vessel is made easier than that of the glass envelope of the prior art.

Due to the specific discharge geometry, in DE 30 08 535 C2 varying current densities occur in different regions of the glass envelope, whereas, due to the geometry of the discharge vessel according to the invention, the field intensity conditions are much more homogeneous, and since optimum, uniform current densities are achieved at all points, greater light efficiency is made possible. Particularly with regard to leakage inductance and thus electromagnetic compatibility (EMC), the design according to the invention is again superior.

In DE 100 58 852 A1, the discharge current flows through the core in a comparably large loop commensurate with the shape of the discharge vessel. This large loop generates considerable leakage inductance and acts as a transmitting antenna for the high frequency current. These problems are almost completely precluded by the present invention. The manufacture of the discharge vessel according to the invention, as well as the assembly of the gas discharge lamp according to the invention is also made simpler than in many embodiments of the prior art.

In the preferred embodiment of the invention, the closed core is designed in the way of a UU-core or UI-core that comprises two parallel, straight legs and two connecting legs. An exciter winding is mounted onto each of the two straight legs, the exciter winding being electromagnetically coupled to an associated discharge vessel in the way of a transformer, with the exciter winding corresponding to a primary winding and the discharge vessel to a secondary winding having a single turn. Although it is possible to mount an exciter winding and an associated discharge vessel only on one leg, in this embodiment the relationship of the volume of the core material to the volume of the discharge vessel would be appreciably less favorable. The electromagnetic compatibility is also more favorable in an arrangement having two parallel, wound core legs and associated discharge vessels.

The exciter winding is preferably in a single layer and distributed evenly over the length of the discharge vessel placed over it. The thickness of the winding wire is preferably less than or equal to four times, more preferably less than or equal to three times, the skin penetration depth of the high frequency current that flows through the exciter winding in order to avoid losses due to the skin effect.

The gas discharge lamp is preferably operated at a frequency that lies in the vicinity, particularly slightly under, that frequency that corresponds to the power factor maximum of the core material employed. Concerning the switching losses in known contemporary transistors, good overall efficiency can be expected when the operating frequency lies between 200 kHz and 400 kHz.

In the preferred embodiment of the invention, the discharge vessel is provided on the inside surface of its outer cylindrical wall with a fluorescent coating that transforms the short-wave photons emitted by the plasma within the discharge vessel into visible light. Moreover, the discharge vessel can be provided with a reflective coating on the outside surface of its inner cylindrical wall in order to improve light efficiency. Care must be taken here to ensure that the reflective coating cannot act as a short-circuit ring.

In other embodiments, there is no need to provide a fluorescent coating on the discharge vessel if either a frequency shift of the radiation of the excited atoms is not desired or not required, such as in a UV lamp, or when an active medium is used that emits in the visible spectral range or when the fluorescent coating is applied to an outer protective glass envelope that envelops the device according to the invention.

In an advantageous embodiment of the invention, the outside diameter of the discharge vessel is less than twice the diameter of the enclosed exciter winding on the ferrite core.

BRIEF DESCRIPTION OF DRAWINGS

The invention is described in more detail below on the basis of a preferred embodiment with reference to the drawings. The figures show:

FIG. 1 a schematic view of an electrodeless gas discharge lamp according to a preferred embodiment of the invention;

FIG. 2*a* to 2*c* a schematic perspective view of the discharge vessel of the gas discharge lamp as well as a schematic sectional view and a schematic view from above of the discharge vessel;

FIG. 3 a schematic view from above of the gas discharge vessel of FIG. 2*a;*

FIG. 4*a* and 4*b* schematic views of a first and a second embodiment of the soft magnetic core of the gas discharge lamp according to the invention;

FIG. 5 a schematic view of a part of the core illustrated in FIG. 4*a* on which windings have been mounted; and FIG. 6*a* and 6*b* schematic views of the gas discharge lamp according to the invention in accordance with the first and a second embodiment.

DETAILED DESCRIPTION

FIG. 1 shows a schematic view of a preferred embodiment of the electrodeless gas discharge lamp according to the invention. The gas discharge lamp comprises a closed core 10, having a preferably round cross-section at least in the region in which the windings are applied, which can be designed, for example, in the way of a UU-core or UI-core. In the embodiment of FIG. 1, a UI-core 10 is shown that comprises a U-piece 10' and an I-piece 10". The core 10 comprises two parallel straight legs 12 on which exciter windings 14 are mounted. A person skilled in the art would realize that the exact shape given to the parts of the core 10 could also be different to those shown in FIG. 1.

Each of the parallel straight legs 12 of the core 10 are led through a discharge vessel 16 that takes the form of a hollow cylindrical ring. The discharge vessel 16 is preferably made of glass. It is filled with a gaseous medium in which, due to an electric alternating field induced therein, an electric discharge (gas discharge) takes place that emits UV radiation or visible light. This medium comprises, for example, metal vapor and rare gas, such as mercury vapor and a rare gas mixture of argon and krypton at a pressure of 2 mbar, for example. The specific composition and the actual gas pressure of the active medium within the discharge vessel are not the subject matter of the invention. The arrangement according to the invention makes gas discharges possible in practically any medium, provided that the gas pressure is low (millibar range or lower). The criteria for choosing the best active media include light efficiency, spectral distribution and perhaps low toxicity (lamp breakage, disposal).

Whereas in FIG. 1 a large number of components of the gas discharge lamp according to the invention, such as the terminals for the exciter windings 14, a high frequency oscillator, supports etc., are not shown, the person skilled in the art will be aware of the need to complete these missing components.

As mentioned above, the electrodeless gas discharge lamp according to the invention acts as a transformer. To enable it to emit light, the core 10 is provided with the exciter winding 14 as a primary winding. Instead of a secondary winding, the discharge vessel 16 is disposed in the direct vicinity of the exciter winding 14, around the winding. The distance between the exciter winding 14 and the inner wall of the discharge vessel 16 is preferably kept as small as possible. Moreover, the discharge vessel 16 preferably extends over the entire windable length of the associated leg 12, as shown in FIG. 1. The exciter winding 14 induces a magnetic alternating field in the core 16, so that a plasma is generated and maintained in the discharge vessel 16 through electromagnetic induction. In the gas discharge, atoms are excited to higher energy levels by electron collisions. On their return to lower energy levels or to the normal state, ultraviolet radiation or visible light is emitted.

The specific geometric shape of the discharge vessel and the arrangement of this same vessel directly over the exciter winding on a closed highly permeable ferrite core, makes it possible to achieve excellent coupling between the exciter winding (primary winding) and the plasma within the discharge vessel (secondary winding), so that minimum leakage inductance and electromagnetic interference (EMI) is produced. In the entire discharge region, uniform field intensities and current densities are achieved, so that optimum uniform conditions for light emission are created over the entire circumference and the entire length of the discharge vessel 16. The light emission is indicated schematically in FIG. 1 by arrows. FIG. 2*a*, 2*b* and 2*c* schematically show a perspective view as well as a sectional view and a view from above of the discharge vessel 16. The axial length of the hollow cylindrical ring preferably corresponds to the wound length of an associated core leg 12. The inside diameter is dimensioned such that the discharge vessel 16 encloses the wound core leg 12 at a short radial spacing.

As schematically indicated in the view from above of the discharge vessel 16 in FIG. 3, the outside surface of the inner cylinder wall can be provided with a reflective coating 18 so as to increase light emission. If this coating 18 is electrically conductive it has to be interrupted in a circumferential direction in order to avoid short circuits within the circular electric field in the discharge vessel 16. The coating 18 is preferably electrically non-conductive.

FIG. 4*a* and 4*b* illustrate how the closed core 10 can be made from a U-piece 10' and an I-piece 10" or from two U-pieces 10'. It is of course possible to build the core 10 up from more or from fewer individual pieces than shown in the figures. The core 10 consists of a soft magnetic material, preferably a ferrite material having low losses at high operating frequencies. After the windings have been applied and after being assembled with the gas discharge vessel, the individual pieces of the core 10 can be permanently connected by such means as bonding or detachably connected using terminal screws. The windings 14 are mounted on the core on an insulating layer or on a simple winding former.

FIG. 5 schematically shows a wound U-piece 10' of the core 10, each leg 12 carrying an exciter winding 14. The exciter winding 14 is preferably mounted in a single layer on the associated leg 12, wherein the winding wire should not be thicker than three to four times the skin penetration depth of the high frequency current in order to prevent losses due to the skin effect. If a larger wire cross-section is required, the winding should be divided into several winding sections connected in parallel, each one of which satisfies the above criterion.

In order to achieve maximum efficiency, the operating frequency of the lamp should lie in the vicinity of, although slightly under, the power factor maximum of the core material employed. Taking into account switching losses and the transistors available today, an excellent overall efficiency can be expected when the operating frequency lies between 200 kHz and 400 kHz.

As mentioned above, the plasma in the discharge vessel more or less forms the secondary winding of a transformer having a single short-circuited winding that has a high coupling factor with the primary winding (exciter winding 14). Because of plasma impedance, however, this does not involve a short circuit in the conventional sense, but rather the induced energy in the effective resistance of the plasma is transformed. This arrangement ensures excellent transformation efficiency and outstanding EMI properties (EMC). According to the invention, a closed core 10 having two parallel, straight legs 12 is preferably provided, onto which windings 14 are mounted in a symmetric manner in order to form induction coils. Each induction coil is associated with a discharge vessel 16; see FIG. 6*a*. As shown in FIG. 6*b*, however, it is also possible to produce a gas discharge lamp having only one wound leg and one gas discharge vessel 16. It is, however, clear that the relationship of the core volume to the volume of the discharge vessel is less favorable than in the embodiment of FIG. 6*a*. In the embodiment of FIG. 6*a* there are consequently less core losses. The EMC is also better than in the embodiment having only one discharge vessel.

The gas discharge lamp according to the invention has the following advantages compared to the prior art:

The close magnetic coupling between the exciter winding 14 (primary winding) and the plasma generated in the discharge vessel (secondary winding) results in minimum leakage inductance and interference radiation. Due to the specific geometry of the core and the discharge vessel, uniform field intensities and current densities can be achieved in the entire discharge region. This results in optimum light emission and higher efficiency over the entire circumference and the entire length of the gas discharge vessel.

Another advantage is the complete separability between the discharge vessel and the core as well as the ease of manufacture of the discharge vessel.

Examples for the composition of the active medium within the discharge vessel, the fluorescent coating 19 and the reflective coating 18 as well as examples for other protective layers and such can be found in DE 100 58 852 A1.

The characteristics revealed in the above description, the claims and the figures can be important for the realization of the invention in its various embodiments both individually and in any combination whatsoever.

IDENTIFICATION REFERENCE LIST

10 Core
10' U-piece of the core
10" I-piece of the core
12 Leg
14 Exciter winding
16 Discharge vessel
18 Reflective coating
20 Core

The invention claimed is:

1. An electrodeless high frequency, low pressure gas discharge lamp according to the induction principle for transforming electric energy into ultraviolet or visible light having a soft magnetic core on which a primary winding is mounted, and having a discharge vessel, wherein the core has a closed form and the discharge vessel comprising of a pair of concentric elongated generally cylindrical walls and has a hollow cylindrical form and encloses a straight leg of the closed core, wherein the primary winding is at least partly located between the discharge vessel and the core, wherein the closed core is formed in the way of a UU-core or a UI-core and comprises two parallel straight legs as well as two connecting legs, wherein primary windings are mounted on the two straight legs and a discharge vessel encloses each of the two straight legs.

2. A lamp according to claim 1, wherein the primary winding is mounted in a single layer on the straight leg and coupled to the discharge vessel in the way of a transformer, wherein the discharge vessel corresponds to a secondary winding having one turn.

3. A lamp according to claim 2, wherein the thickness of the winding wire is less than or equal to four times the skin penetration depth of the high frequency current that flows through the primary winding.

4. A lamp according to claim 1, wherein the operating frequency of the primary coil lies in the range of 200 kHz to 400 kHz.

5. A lamp according to claim 1, wherein the discharge vessel is provided with a reflective coating on the outside surface of its inner cylindrical wall.

6. A lamp according to claim 1, wherein the discharge vessel is provided with a fluorescent coating on the inside surface of its outer cylindrical wall.

7. A lamp according to claim 1, wherein a protective glass envelope, which has a fluorescent coating, is placed over the lamp.

8. An electrodeless gas discharge lamp comprising:

a closed magnetic core;

at least one primary winding wound around a portion of said core; and a hollow tubular discharge vessel comprising of a pair of concentric elongated generally cylindrical walls and enclosing at least a portion of said wound portion of said core;

a second winding wound around a second portion of said core and a second hollow tubular discharge vessel enclosing at least a portion of said second wound portion of said core.

9. The electrodeless gas discharge lamp of claim 8 wherein said wound portion of said core includes a straight leg of said core and wherein said discharge vessel is generally cylindrical.

10. The electrodeless gas discharge lamp of claim 9 wherein said gas discharge vessel encloses substantially the entire length of said wound straight leg of said core.

11. The electrodeless gas discharge lamp of claim 8, wherein the second hollow tubular discharge vessel comprises a second pair of concentric elongated generally cylindrical walls.

12. The electrodeless gas discharge lamp of claim 11, wherein the second hollow tubular discharge vessel is not concentric with the a hollow tubular discharge vessel.

13. The electrodeless gas discharge lamp of claim 8, wherein a protective glass envelope, which has a fluorescent coating, encloses the lamp.

14. The electrodeless gas discharge lamp of claim 8, wherein the hollow tubular discharge vessel encloses the entire wound portion of said core.

* * * * *